US010161410B2

(12) United States Patent
Peck et al.

(10) Patent No.: US 10,161,410 B2
(45) Date of Patent: Dec. 25, 2018

(54) SEAL BRACKET ASSEMBLY AND PUMP AND MOTOR SYSTEM INCLUDING SAME

(71) Applicant: Geiger Pump & Equipment, Baltimore, MD (US)

(72) Inventors: Henry Peck, Lutherville, MD (US); Kerri Murphy, Plymouth Meeting, PA (US); Rebekah Macko, Philadelphia, PA (US)

(73) Assignee: GEIGER PUMP & EQUIPMENT, Baltimore, MD (US)

( * ) Notice: Subject to any disclaimer, the term of this patent is extended or adjusted under 35 U.S.C. 154(b) by 347 days.

(21) Appl. No.: 15/016,822

(22) Filed: Feb. 5, 2016

(65) Prior Publication Data

US 2016/0245294 A1 Aug. 25, 2016

Related U.S. Application Data

(60) Provisional application No. 62/120,166, filed on Feb. 24, 2015.

(51) Int. Cl.

| | |
|---|---|
| ***F04D 13/08*** | (2006.01) |
| ***F04D 29/08*** | (2006.01) |
| ***F04D 1/00*** | (2006.01) |
| ***F04D 13/06*** | (2006.01) |
| ***F04D 29/60*** | (2006.01) |

(52) U.S. Cl.

CPC ..... *F04D 29/086* (2013.01); *F04D 1/00* (2013.01); *F04D 13/06* (2013.01); *F04D 13/086* (2013.01); *F04D 29/605* (2013.01); *F05D 2260/6022* (2013.01)

(58) Field of Classification Search

CPC ..... F04D 13/083

See application file for complete search history.

(56) References Cited

U.S. PATENT DOCUMENTS

| | | | |
|---|---|---|---|
| 1,970,484 | A | 8/1934 | Arutunoff |
| 2,171,749 | A | 9/1939 | Hollander et al. |
| 3,072,810 | A | 1/1963 | Luenberger |

(Continued)

FOREIGN PATENT DOCUMENTS

| | | | |
|---|---|---|---|
| CN | 1085637 | A | 4/1994 |
| CN | 201723458 | U | 1/2011 |

(Continued)

*Primary Examiner* — Patrick Hamo

(74) *Attorney, Agent, or Firm* — Eckert Seamans Cherin & Mellott, LLC; Stephen A. Bucchianeri

(57) ABSTRACT

A seal bracket assembly includes a coupling member having: a first end for sealingly engaging a pump; an opposite second end for sealingly engaging a source of rotary force; a passage defined therein which extends between the first and second ends which is structured to accommodate therein a linkage coupling an output shaft of the source of rotary force and an input shaft of the pump; and a drain port defined in the coupling member which extends between the passage and an outer surface of the coupling member. The assembly further includes an air tank which defines an air space of a predetermined volume therein and includes and an inlet, coupled to the drain port such that the passage and the air space are in fluid communication with each other, and an outlet, which is the only opening to the surrounding environment.

19 Claims, 6 Drawing Sheets

(56) References Cited

U.S. PATENT DOCUMENTS

| | | | |
|---|---|---|---|
| 3,182,214 | A | 5/1965 | Boyd |
| 3,270,224 | A | 8/1966 | Turk |
| 3,294,993 | A | 12/1966 | Komor et al. |
| 3,304,877 | A | 2/1967 | Carter et al. |
| 3,502,919 | A | 3/1970 | Boyd et al. |
| 3,702,740 | A | 11/1972 | Pettigrew |
| 3,764,233 | A | 10/1973 | Strickland |
| 3,814,446 | A | 6/1974 | Derman |
| 3,859,951 | A | 1/1975 | Woodfill |
| 4,053,196 | A | 10/1977 | Dunaway |
| 4,101,139 | A | 7/1978 | Nordin |
| 4,125,265 | A | 11/1978 | Grzesiak |
| 4,190,400 | A | 2/1980 | Sloan |
| 4,249,865 | A | 2/1981 | Sloan |
| 4,421,999 | A | 12/1983 | Beavers et al. |
| 4,496,866 | A | 1/1985 | Yamamoto et al. |
| 4,586,880 | A | 5/1986 | Inao et al. |
| 4,626,721 | A | 12/1986 | Ouchi |
| 4,919,343 | A | 4/1990 | Van Luik, Jr. et al. |
| 5,053,661 | A | 10/1991 | Kitamura et al. |
| 5,340,273 | A | 8/1994 | Rockwood |
| 5,522,709 | A | 6/1996 | Rhoades |
| 5,947,051 | A | 9/1999 | Geiger |
| 6,053,423 | A | 4/2000 | Jacobsen et al. |
| 6,231,315 | B1 | 5/2001 | Ikeda et al. |
| 6,269,954 | B1 | 8/2001 | Baltzer |
| 6,379,127 | B1 | 4/2002 | Andrews et al. |
| 6,422,822 | B1 * | 7/2002 | Holmes ..... F04D 13/083 417/13 |
| 6,450,782 | B1 | 9/2002 | Sakamoto |
| 6,530,759 | B2 | 3/2003 | Sano et al. |
| 6,626,714 | B2 | 9/2003 | Nozue |
| 6,783,322 | B2 | 8/2004 | Ray et al. |
| 7,247,005 | B2 | 7/2007 | Fuchida et al. |
| 7,344,356 | B1 | 3/2008 | Howell et al. |
| 7,434,460 | B2 | 10/2008 | Matsuura et al. |
| 7,530,391 | B2 | 5/2009 | Hall et al. |
| 8,246,251 | B1 | 8/2012 | Gardner |
| 8,287,209 | B2 | 10/2012 | Feldman et al. |
| 8,808,041 | B2 | 8/2014 | Hine et al. |
| 2006/0270473 | A1 | 11/2006 | Straeter |
| 2014/0212220 | A1 | 7/2014 | Pierce |
| 2014/0268411 | A1 | 9/2014 | Sekii |

FOREIGN PATENT DOCUMENTS

| | | | |
|---|---|---|---|
| CN | 101360910 | B | 9/2011 |
| CN | 202488308 | U | 10/2012 |
| CN | 202811154 | U | 3/2013 |
| CN | 202937388 | U | 5/2013 |
| CN | 103305203 | A | 9/2013 |
| EP | 0 201 263 | A1 | 12/1986 |
| JP | 10184584 | A | 7/1998 |

* cited by examiner

SEAL BRACKET ASSEMBLY AND PUMP AND MOTOR SYSTEM INCLUDING SAME

CROSS REFERENCE TO RELATED APPLICATION

This application claims priority under 35 U.S.C. § 119(e) from U.S. Provisional Application No. 62/120,166, entitled "SEAL BRACKET ASSEMBLY AND PUMP AND MOTOR SYSTEM INCLUDING SAME", which was filed on Feb. 24, 2015, the disclosure of which is incorporated herein by reference.

BACKGROUND OF THE INVENTION

1. Field of the Invention

The present invention relates generally to fluid pumping systems and, more particularly, to fluid pumping systems, such as those which are used for pumping fuel oil, which are resistant to flooding. The present invention also relates to a seal bracket assembly for use in pumping systems which provides for flood resistance and which may be used in new installations or readily retrofit to existing installations.

2. Description of Related Art

Current equipment presently utilized in fuel oil systems for heating and emergency backup power are typically located in basements of buildings where, during bad weather, flooding can commonly occur. For example, in 2012, Hurricane Sandy caused vast flooding in several states along the eastern seaboard of the United States, particularly causing extreme flooding in New York City, taking out the emergency backup power supplies for many large buildings.

Typically, such fuel oil systems, such as system 10 shown in FIG. 1, include a fuel oil pump 12 which is "long coupled" to an electric motor 14. In other conventional systems, such as system 20 shown in FIG. 2, a bracket configuration is alternatively employed wherein a rigid bracket member 22 is utilized to couple a fuel oil pump 24 to an electric motor 26. In each case, the pump 12,24 is coupled to the electric motor 14, 26 in a manner that leaves the linkage 16,28 between the motor 14,26 and the pump 12,24, and thus the shafts (not numbered) of both the motor 14,26 and the pump 12,24, completely exposed to the surrounding environment. For example, a long coupled configuration 10 (such as shown in FIG. 1) generally leaves the linkage 16 (shown schematically in dashed line) between the pump 12 and motor 14 exposed as a safety shield 18, employed simply to keep items from becoming entangled in the linkage 16, is generally the only structure near the linkage 16. Similarly, a standard bracket 22 (such as shown in FIG. 2) typically includes multiple openings 30 (only one is shown in the view of FIG. 2) for providing access, both visual and physical, to the linkage 28. For safety reasons, such openings 30 are typically covered with a mesh or other non-sealed structure. The problem with both arrangements is that water can enter the pump 12,24 and/or electric motor 14,26 via the shaft thereof and damage the pump 12,24, motor 14,26 and even related system equipment. Accordingly, such standard conventional pump/motor systems 10,20 cannot function in flood conditions, and many places do not have the resources or space needed to redesign such existing systems and/or relocate such systems 10,20 to other locations.

It thus would be desirable to provide an improved system that is resistant to flooding. It would also be desirable to provide an assembly which may be readily retrofit to existing installations and provide flood resistance.

SUMMARY OF THE INVENTION

Embodiments of the present invention allow for standard equipment (i.e., commercially available pumps and motors) to work in both normal, dry conditions and also when there is flooding by keeping water from infiltrating either one or both of the pump and/or motor via the shaft coupling between the pump and motor.

Embodiments of the present invention keep pumping systems running during flooding by using standard equipment and an inventive housing assembly that has a small footprint. Not only does such novel arrangement enable the user to keep their existing equipment in place but allows for the possibility of retrofitting existing systems. By not putting the equipment in a completely different area and/or sealing it in a bulky enclosure, users will retain ready access to their equipment and thus be able to conduct inspections and provide maintenance quickly and easily.

In one embodiment of the present invention a seal bracket assembly for use in a pumping system is provided. The seal bracket assembly comprises a coupling member including: a first end structured to be sealingly engaged with a pump; an opposite second end structured to be sealingly engaged with a source of rotary force; a passage defined within the coupling member extending between the first end and the second end, the passage being structured to accommodate therein a linkage coupling an output shaft of the source of rotary force and an input shaft of the pump; and a drain port defined in the coupling member and extending between the passage and an outer surface of the coupling member. The seal bracket assembly further comprises an air tank defining an air space of a predetermined volume therein. The air tank includes an inlet coupled to the drain port of the coupling member such that the passage and the air space are in fluid communication with each other and an outlet. When the coupling member is sealingly engaged to both the pump and the source of rotary force the passage and the air space are isolated from the surrounding environment except for at the outlet.

The source of rotary force may comprise an electric motor.

The coupling member may further comprise an access port defined in the coupling member and extending between the passage and the outer surface of the coupling member.

The coupling member may further comprise a glass viewport which is selectively coupled to the access port.

The inlet of the air tank may be directly coupled to the drain port of the coupling member.

The inlet of the air tank may be coupled to the drain portion of the coupling member via an intermediary conduit member.

In another embodiment of the invention a pumping system is provided. The pumping system comprises: a pump; a source of rotary force; and a seal bracket assembly. The seal bracket assembly comprises a coupling member. The coupling member includes: a first end sealingly engaged with the pump; an opposite second end sealingly engaged with the source of rotary force; a passage defined within the coupling member extending between the first end and the second end, the passage having disposed therein a linkage coupling an output shaft of the source of rotary force and an input shaft of the pump; and a drain port defined in the coupling member and extending between the passage and an outer surface of the coupling member. The seal bracket assembly further includes an air tank defining an air space of a predetermined volume therein. The air tank includes an inlet coupled to the drain port of the coupling member such that the passage and the air space are in fluid communication with each other and an outlet. The passage and the air space are isolated from the surrounding environment except for at the outlet.

The outlet may be disposed at or near a lower-most portion of the air tank.

The source of rotary force may comprise an electric motor.

The coupling member may further comprise an access port defined in the coupling member and extending between the passage and the outer surface of the coupling member.

The coupling member may further comprise a glass viewport which is selectively coupled and sealing engages the access port.

The inlet of the air tank may be directly coupled to the drain port of the coupling member.

The drain port of the coupling member may be disposed below the linkage.

The inlet of the air tank may be coupled to the drain portion of the coupling member via an intermediary conduit member.

In yet another embodiment of the invention a coupling member for use in preventing water infiltration into a pump or source of rotary force which is coupled to the pump via a linkage is provided. The coupling member comprises: a first end structured to be sealingly engaged with the pump; an opposite second end structured to be sealingly engaged with the source of rotary force; a passage defined within the coupling member extending between the first end and the second end, the passage being structured to accommodate the linkage therein; and a drain port defined in the coupling member and extending between the passage and an outer surface of the coupling member. When the coupling member is sealingly engaged to both the pump and the source of rotary force the passage is isolated from the surrounding environment except for at the drain port.

The coupling member may further comprise an access port defined therein and extending between the passage and the outer surface of the coupling member.

The coupling member may further comprise a glass viewport selectively coupled to, and sealing engaged with, the access port.

In yet a further embodiment of the invention a method of preventing water infiltration into one or both of a pump and a source of rotary force is provided. The method comprises: providing a coupling member as previously described; sealingly engaging the first end of the coupling member with the pump; sealingly engaging the second end of the coupling member with the source of rotary force; and securing a linkage, which is disposed within the passage of the coupling member, to at least one of the pump and the source of rotary force.

The method may further comprise: providing an air tank defining an air space of a predetermined volume therein, the air tank including an inlet and an outlet; and sealingly engaging and coupling the inlet of the air tank to the drain port of the coupling member such that the passage and the air space are in fluid communication with each other.

DETAILED DESCRIPTION OF EXEMPLARY EMBODIMENTS

Figure 1:
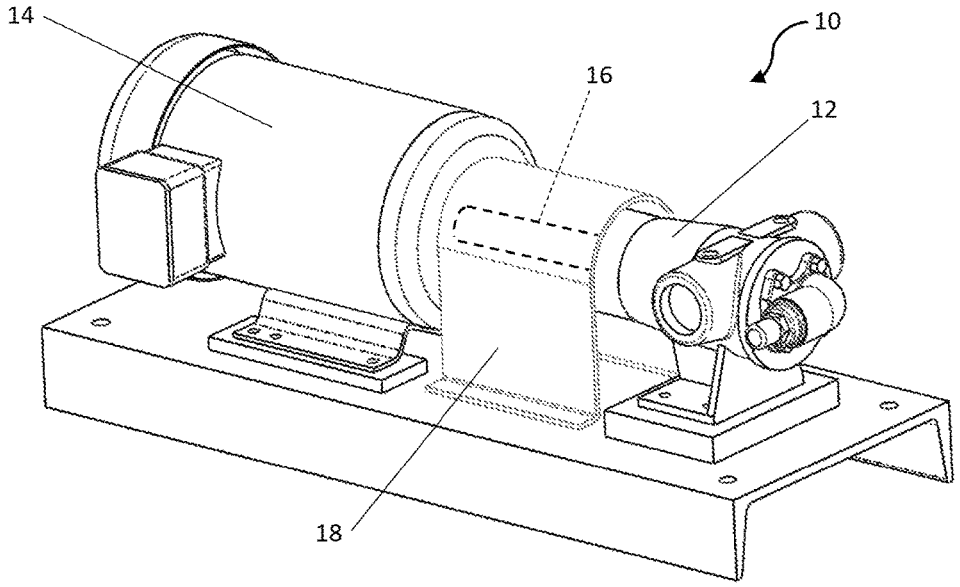
FIG. 1 Prior Art
FIG. 1 is an example of a conventional "long coupled" fuel oil pump/motor arrangement.
Figure 2:
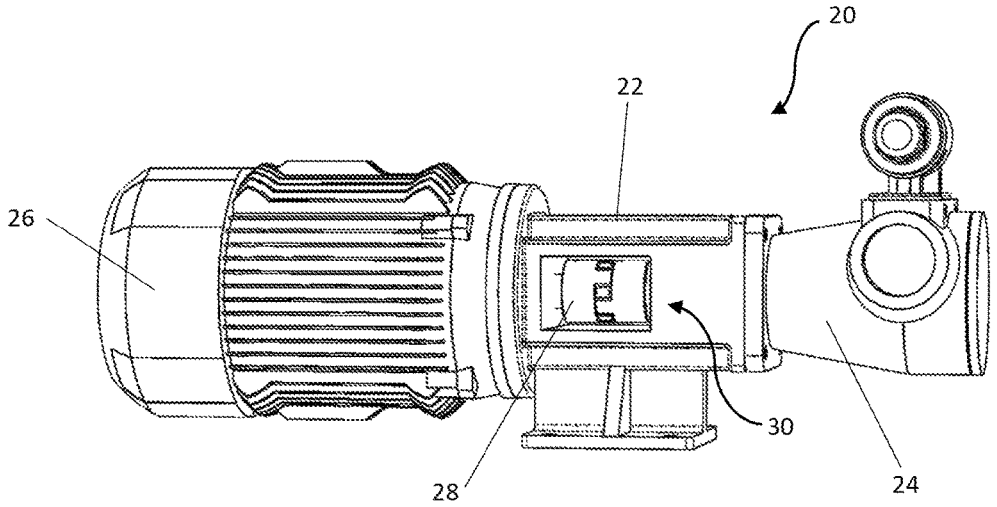
FIG. 2 Prior Art
FIG. 2 is an example of a fuel oil pump/motor coupled using a conventional bracket arrangement.
Figure 3:
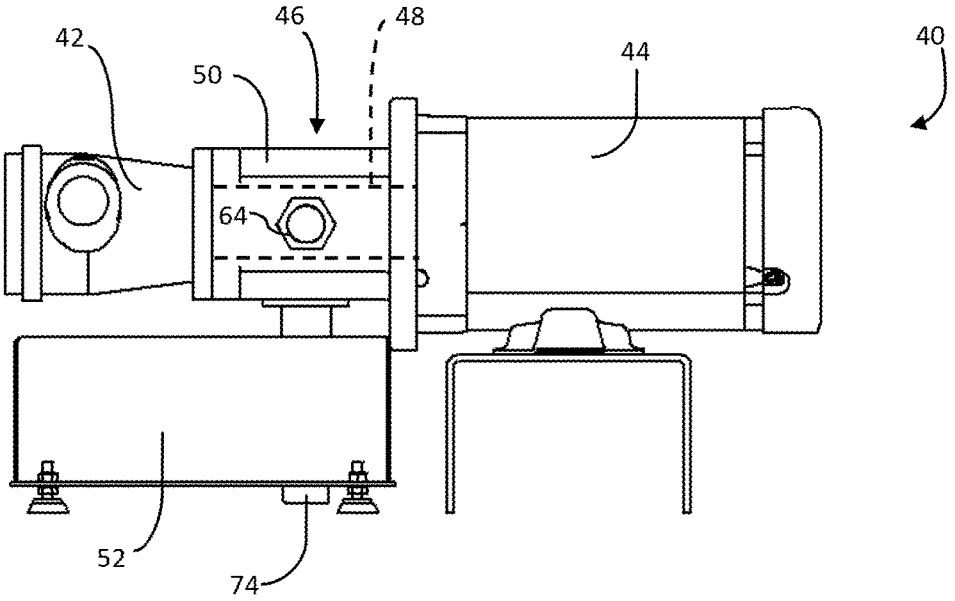
FIG. 3 is a side elevation view of pump/motor system including a seal bracket assembly in accordance with an example embodiment of the present invention.

FIG. 3 illustrates a pumping system 40 in accordance with an exemplary embodiment of the present concept. The pumping system 40 includes a pump 42 which is coupled to a mechanism for providing rotational force, such as an electric motor 44. Pump 42 is coupled to electric motor 44 via a seal bracket assembly 46. Pump 42 is shown for exemplary purposes only and is not intended to be limiting upon the present invention. Instead, it is to be appreciated that pump 42 may be any suitable pumping mechanism of a "close coupled" nature for pumping fuel oil or generally any other fluids which is driven by a rotating shaft without varying from the scope of the present invention. Electric motor 44 is also shown for exemplary purposes only and is not intended to be limiting upon the present invention. Instead, it is also to be appreciated that electric motor 44 may be any suitable mechanism for providing rotational force to pump 42. In example embodiments of the invention in which an electric motor is employed, but the main features needed on the motor are that it of a close coupled design per NEMA or IEC standards, TENV enclosure minimum and at least an IP55 rating. A suitable linkage 48 (shown schematically in hidden line) couples the output shaft (not numbered) of electric motor 44 to the input shaft (not numbered) of pump 42 in a manner such that electric motor 44 may rotationally drive pump 42 in a manner such as commonly known in the art. Any suitable linkage 48 may be employed without varying from the scope of the present invention. As will be discussed in further detail below, seal bracket assembly 46 provides for pumping system 40 to operate normally whether system 40 is in normal (dry) conditions, fully submerged under water (within design parameters as discussed below), or at any point in between.

Figure 4:
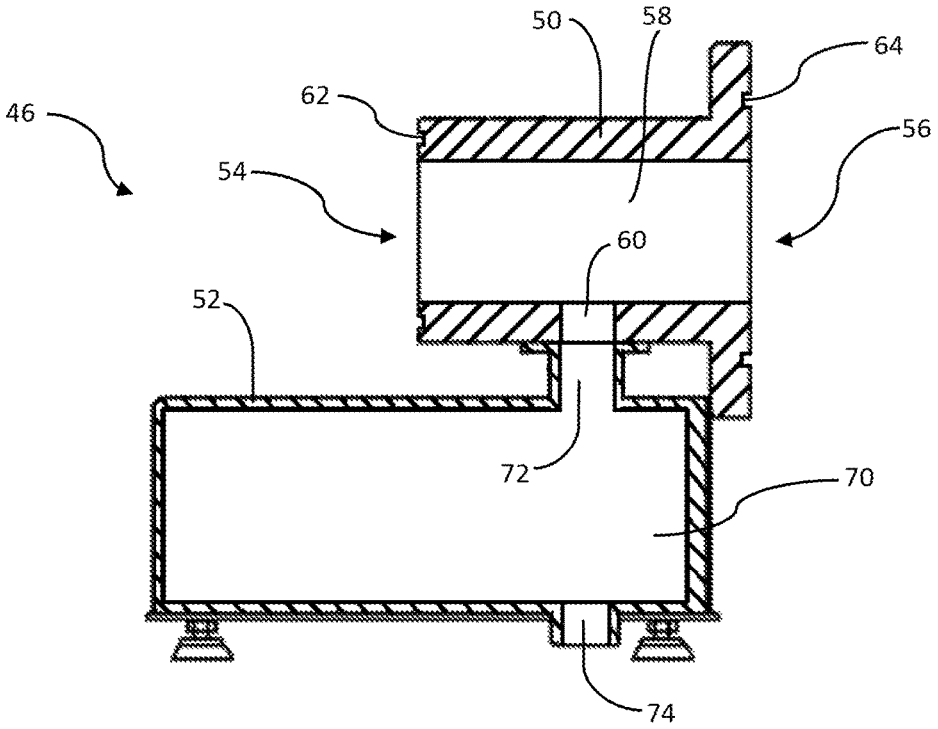
FIG. 4 is a sectional side elevation view through the center of the seal bracket assembly of FIG. 3.

Continuing to refer FIG. 3, as well as to FIG. 4 (which shows a cross-sectional side view through the center of the seal bracket assembly 46) and FIGS. 8-11, the seal bracket assembly 46 generally includes a coupling member 50 and an air tank 52. Coupling member 50 includes a first end 54 which is structured to be coupled to pump 42, an opposite second end 56 which is structured to be coupled to electric motor 44, a passage 58 which extends between the first end 54 and the second end 56 which is structured to allow for the linkage 48 to be disposed and freely rotate therein, and a drain port 60 which extends between the passage 58 and the bottom (not numbered) of the coupling member 50. Each the first and second ends 54 and 56 of the coupling member 50 are structured to sealingly engage pump 42 and motor 44 in a manner which provides an air-tight seal to the pump 42 and electric motor 44, respectively. As used herein, the phrase "sealingly engage" shall be used to refer to an engagement between two or more elements that results in a water and air-tight seal between the elements. The seals between coupling member 50 and pump 42 and electric motor 44 prevent air from escaping passage 58 while at the same time prevent water from entering passage 58, and the pump and motor shafts disposed therein. In order to accomplish such sealed couplings, the first and second ends 54 and 56 may include one or more grooves 62, 64 formed therein for housing an o-ring in this case (not illustrated). It is to be appreciated, however, that the air-tight seal between coupling member 50 and one or both of the pump 42 and/or the electric motor 44 could be accomplished via an o-ring, gasket or any other suitable sealing method by engineering standards, without varying from the scope of the present invention.

Continuing to refer to FIGS. 3, 4, 8 and 9, in the exemplary illustrated embodiment, coupling member 50 further includes a glass viewport 64 (FIG. 3) which engages a side port 66 (FIGS. 8 and 9) disposed on the side of coupling member 50 in a manner such that an air-tight seal is formed. Such engagement between glass viewport 64 and side port 66 may be accomplished via a threaded engagement, gasketed and/or o-ringed interface, or any other suitable arrangement without varying from the scope of the present invention. Glass viewport 64 generally serves two purposes: maintenance and visual aid. For example, to reach the linkage 48 extending between the shaft of pump 42 and the shaft of electric motor 44 in the event of maintenance, glass viewport 64 may simply be removed (i.e., unsealed from coupling member 50) to gain access to linkage 48 through side port 66. Glass viewport 64 also allows the user to view any leakage from pump 42, damage to linkage 48, as well as rotation of linkage 48 for startup purposes while glass viewport 64 is engaged with coupling member 50.

When coupling member 50 is coupled to both pump 42 and electric motor 44 using an air-tight seal (and when glass viewport 64 is engaged via an appropriate seal), such as shown in FIG. 3, passage 58 (defined within coupling member 50) is isolated/sealed from the surrounding environment except for drain port 60 to which air tank 52 is coupled, also via a suitable sealing arrangement. Referring to FIGS. 3, 4 and 13-15, air tank 52, defines an air space 70 therein which is structured to contain a predetermined volume of air (discussed further below). When air tank 52 is considered alone (i.e., not coupled to coupling member 50), space 70 therein is sealed from the surrounding environment aside from at a tank inlet 72, disposed at or near an uppermost portion (not numbered) of air tank 52, and a tank outlet 74, disposed at or near a lowermost portion (not numbered) of air tank 52. When tank inlet 72 is engaged with drain port 60 of coupling member 50 (whether directly as illustrated or via a suitable conduit), passage 58 and air space 70 are in communication with each other and sealed from the surrounding environment except for tank outlet 72. In other words, when seal bracket assembly 46 is installed between pump 42 and electric motor 44 such as show in FIG. 3, the only opening from the environment into the interior of seal bracket assembly is via tank outlet 74.

By disposing tank inlet 72 below drain port 60, any leakage from pump 42 can simply self-drain from passage 58 of coupling member 50 and into air space 70 of air tank 52. From there, such leakage may then exit air space 70 via tank outlet 74, where such leakage would typically be contained via a catch basin (not shown) or other suitable arrangement. In order to promote quick draining of any fluids from air tank 52, the bottom of the tank may be angled toward tank outlet 74.

Figure 5:
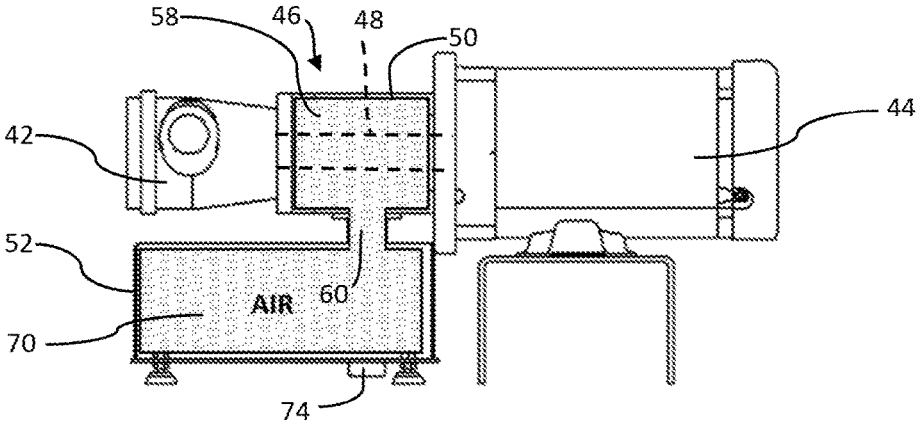
FIG. 5 is a side elevation view of pump/motor system including a seal bracket assembly in accordance with an example embodiment of the present invention shown during normal operating conditions.
Figure 6:
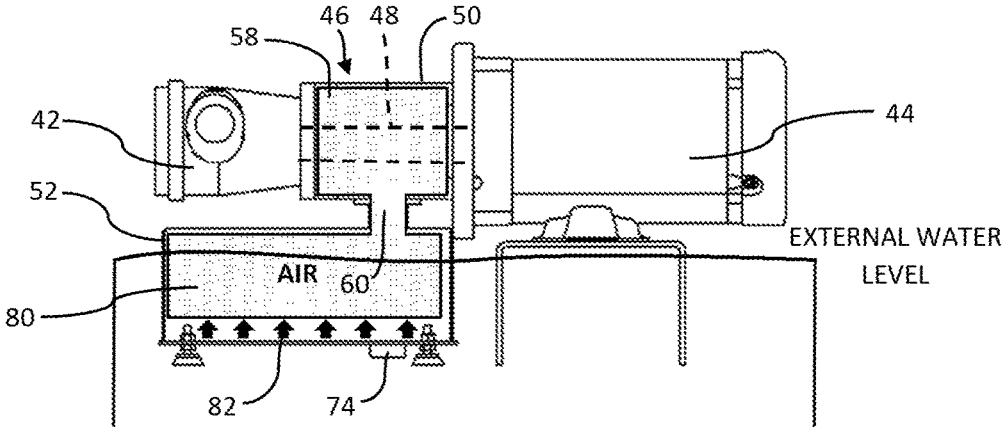
FIG. 6 is a partially schematic side elevation view of pump/motor system including a seal bracket assembly in accordance with an example embodiment of the present invention shown during mild flooding conditions.
Figure 7:
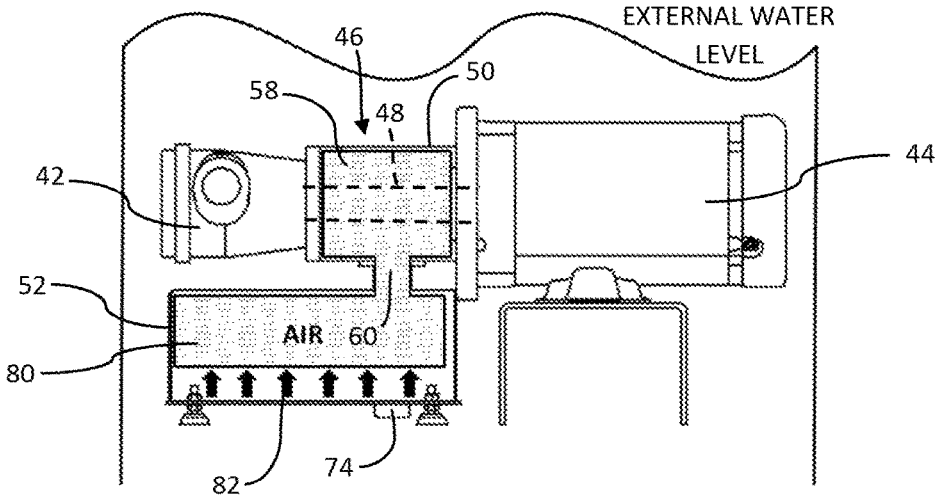
FIG. 7 is a partially schematic side elevation view of pump/motor system including a seal bracket assembly in accordance with an example embodiment of the present invention shown during extreme flooding conditions in which the system is completely submerged by flood waters.
Figure 8:
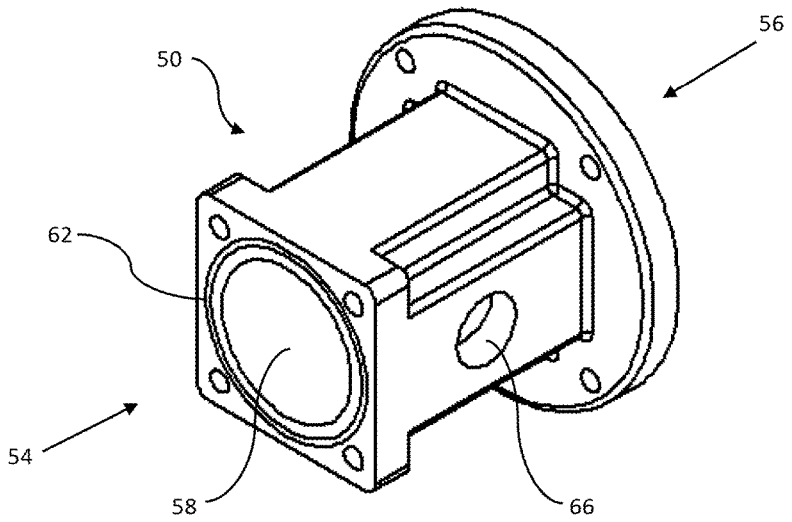
FIG. 8 is an isometric view of a coupling member portion of a seal bracket assembly in accordance with an example embodiment of the present invention.
Figure 9:
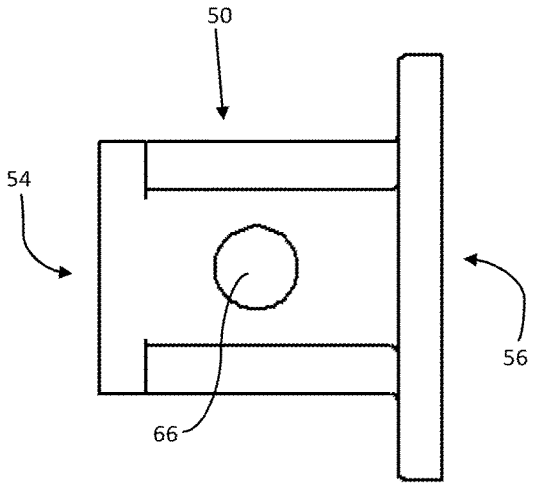
FIG. 9 is a side elevation view of the coupling member of FIG. 8.
Figure 10:
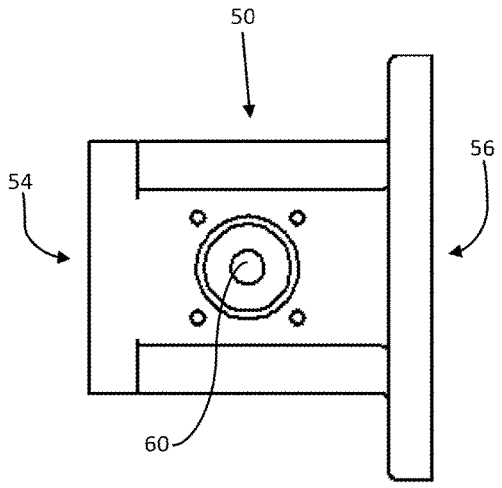
FIG. 10 is a bottom view of the coupling member of FIG. 8.
Figure 11:
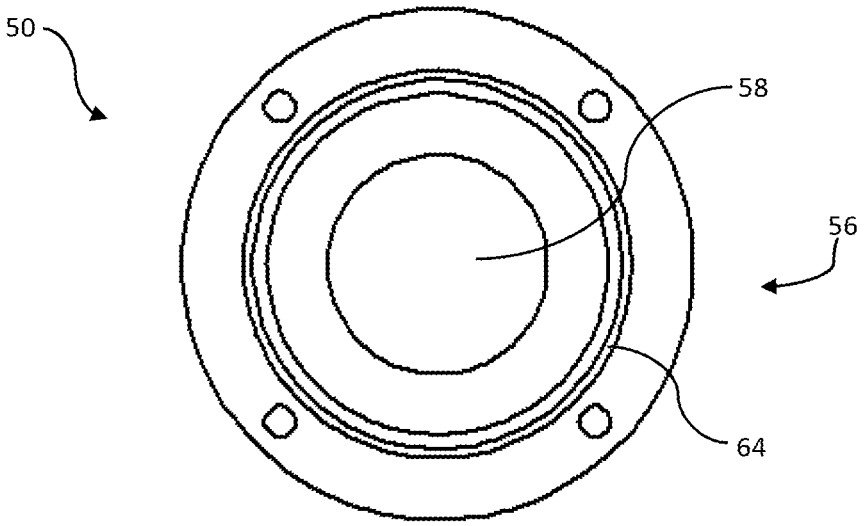
FIG. 11 is an elevation view of the motor engaging end of the coupling member of FIG. 8.
Figure 12:
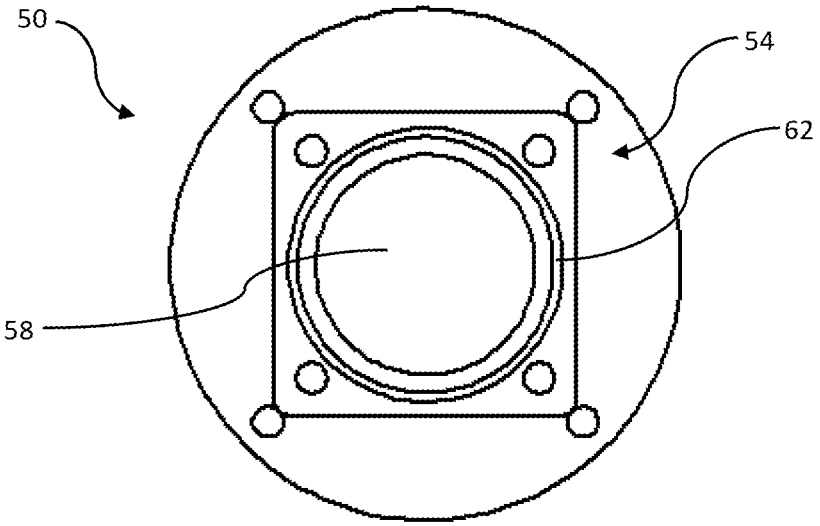
FIG. 12 is an elevation view of the pump engaging end of the coupling member of FIG. 8.
Figure 13:
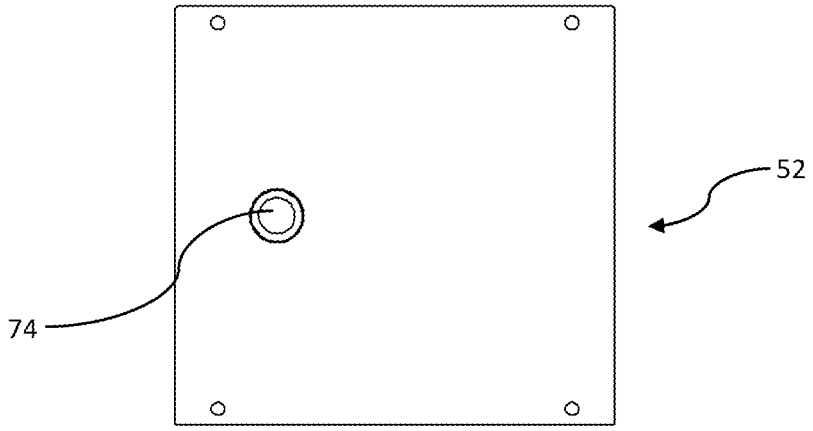
FIG. 13 is a bottom view of the air tank of the seal bracket assembly of FIG. 3.
Figure 14:
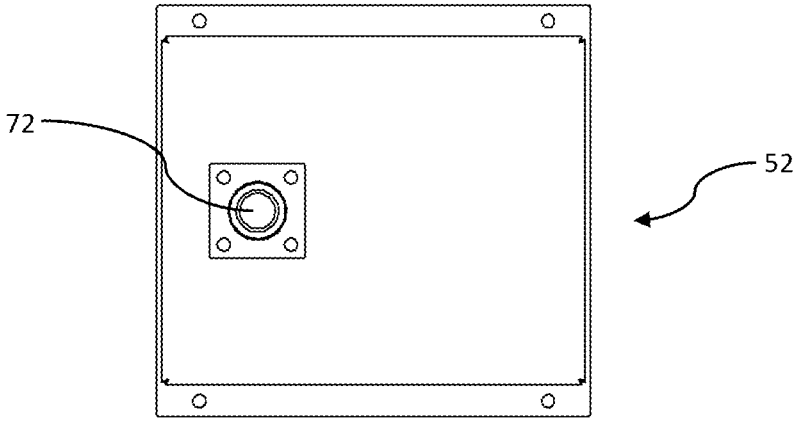
FIG. 14 is a top view of the air tank of the seal bracket assembly of FIG. 3.
Figure 15:
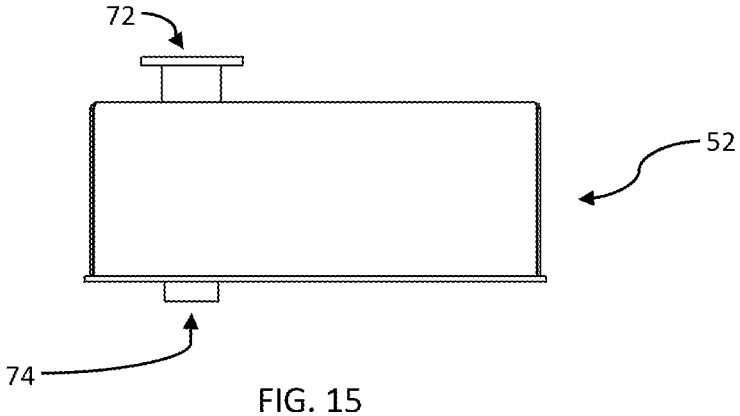
FIG. 15 is a side view of the air tank of the seal bracket assembly of FIG. 3.

Having thus described the general structure and arrangement of an example pumping system 40 including a seal bracket assembly 46 in accordance with an embodiment of the present invention, the general operation of seal bracket assembly during normal use, partial flooding, and severe flooding will now be described in conjunction with FIGS. 5-7 respectively. FIG. 5 shows seal bracket assembly 46 disposed between pump 42 and motor 44 as it would be during normal (i.e., non-flood) operation wherein generally the entirety of air space 70 is filled with ambient air. Referring to FIGS. 6 and 7, as the external water level rises due to flooding, the air pocket 80 trapped (due to the sealed connections between coupling member 50, pump 42 and motor 44) inside seal bracket assembly 46 begins to compress and thus reduce in volume due to the pressure from water entering tank outlet 74. Such pressure exerted by the water is shown generally by the arrows 82 in FIGS. 6 and 7. As the air pocket 80 cannot escape coupling member 50, the air pocket 80 acts to prevent water from getting to linkage 48 extending between pump 42 and motor 44 (as well as from the shafts thereof) within coupling member 50. By preventing water from entering coupling member 50, water is thus prevented from entering pump 42 and motor 44.

From the foregoing description is it to be appreciated that air tank 52 is structured to contain a specific calculated volume of air within (i.e., within air space 70) in order to maintain at least a predetermined volume of compressed air (i.e., the volume needed to keep water from entering coupling member 50) as the level of flood waters rises. Such principle of operation used in conjunction with key features, enables pumping system 40 to perform fully submerged (such as shown in FIG. 7) up to a predetermined submergence as the internal water level within seal bracket assembly 46 is not able to rise to reach the shafts of either pump 42 or motor 44 and damage the equipment. The predetermined submergence level to which the system is designed to withstand may be calculated to any desired amount by simply providing an air tank 52 having an air space 70 of suitable volume.

For example, in accordance with Boyle's Law:

$$P_1V_1=P_2V_2$$

Where $P_1$ is surface pressure, $V_1$ is the volume at the surface, $P_2$ is the pressure at X number of feet of water submergence and $V_2$ is the volume at the depth X.

If we wanted to assume a maximum submergence of 33 ft. (for example, without limitation), wherein the pressure at such depth is equal to 1 atm, we always know that whatever the original volume of air we start with will be one half the volume at 33 ft. of depth because of Boyle's law above:

$$V_2 = \frac{(P_1 V_1)}{P_2} = \frac{(1\ \text{atm} * V_1)}{2\ \text{atm}} = \frac{V_1}{2}$$

For determining a proper size of tank 52, we take a conservative calculation of the theoretical air volume entrapped by the motor 44. Then we can calculate the air volume being held by the coupling member 50 because it is of our own design, and finally add those volumes together and determine the allowance needed to be made up to reach the volume needed for $V_2$. By being conservative on the motor air volume being contained as well as rating the pumps for a submergence less than what they are designed for we are utilizing a safety factor to ensure that the pump set is not pushed beyond its limits. Furthermore, more extensive modeling could be done to confirm such calculations if desired. Such modeling would include not treating air as if it was an ideal gas and more complex calculations.

From the foregoing, it is to be appreciated that the seal bracket assembly in accordance with the present invention is more than just a sealed bracket as it provides a self-draining and a safe design. The reason a sealed bracket is not a complete solution is because over time pumps can leak fluids. Without a suitable pathway for such fluids to exit the bracket, there is a potential for the fluid (fuel oil in this case) to get into the motor, which could present a potential safety hazard to both the pumping system itself as well as anyone in the general vicinity of the system.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A seal bracket assembly for use in a pumping system, the assembly comprising:

a coupling member including:

a first end structured to be sealingly engaged with a pump;

an opposite second end structured to be sealingly engaged with a source of rotary force;

a passage defined within the coupling member extending between the first end and the second end, the passage being structured to accommodate therein a linkage coupling an output shaft of the source of rotary force and an input shaft of the pump; and a drain port defined in the coupling member and extending between the passage and an outer surface of the coupling member; and an air tank defining an air space of a predetermined volume therein, the air tank including:

an inlet coupled to the drain port of the coupling member such that the passage and the air space are in fluid communication with each other; and an outlet, wherein when the coupling member is sealingly engaged to both the pump and the source of rotary force the passage and the air space are isolated from the surrounding environment except for at the outlet.

2. The assembly of claim 1, wherein the source of rotary force comprises an electric motor.

3. The assembly of claim 1, wherein the coupling member further comprises an access port defined in the coupling member and extending between the passage and the outer surface of the coupling member.

4. The assembly of claim 3, wherein the coupling member further comprises a glass viewport which is selectively coupled to the access port.

5. The assembly of claim 1, wherein the inlet of the air tank is directly coupled to the drain port of the coupling member.

6. The assembly of claim 1, wherein the inlet of the air tank is coupled to the drain portion of the coupling member via an intermediary conduit member.

7. A pumping system comprising:

a pump;

a source of rotary force; and a seal bracket assembly comprising:

a coupling member including:

a first end scalingly engaged with the pump;

an opposite second end sealingly engaged with the source of rotary force;

a passage defined within the coupling member extending between the first end and the second end, the passage having disposed therein a linkage coupling an output shaft of the source of rotary force and an input shaft of the pump; and a drain port defined in the coupling member and extending between the passage and an outer surface of the coupling member; and an air tank defining an air space of a predetermined volume therein, the air tank including:

an inlet coupled to the drain port of the coupling member, such that the passage and the air space are in fluid communication with each other; and an outlet, wherein the passage and the air space are isolated from the surrounding environment except for at the outlet.

8. The pumping system of claim 7, wherein the outlet is disposed at or near a lower-most portion of the air tank.

9. The pumping system of claim 7, wherein the source of rotary force comprises an electric motor.

10. The pumping system of claim 7, wherein the coupling member further comprises an access port defined in the coupling member and extending between the passage and the outer surface of the coupling member.

11. The pumping system of claim 10, wherein the coupling member further comprises a glass viewport which is selectively coupled and sealing engages the access port.

12. The pumping system of claim 7, wherein the inlet of the air tank is directly coupled to the drain port of the coupling member.

13. The pumping system of claim 7, wherein the drain port of the coupling member is disposed below the linkage.

14. The pumping system of claim 7, wherein the inlet of the air tank is coupled to the drain portion of the coupling member via an intermediary conduit member.

15. A coupling member for use in preventing water infiltration into a pump or source of rotary force which is coupled to the pump via a linkage, the coupling member comprising:

a first end structured to be sealingly engaged with the pump;

an opposite second end structured to be sealingly engaged with the source of rotary force;

a passage defined within the coupling member extending between the first end and the second end, the passage being structured to accommodate the linkage therein; and a drain port defined in the coupling member and extending between the passage and an outer surface of the coupling member, wherein when the coupling member is sealingly engaged to both the pump and the source of rotary force the passage is isolated from the surrounding environment except for at the drain port.

16. The coupling member of claim 15, further comprising an access port defined therein and extending between the passage and the outer surface of the coupling member.

17. The coupling member of claim 16, further comprising a glass viewport selectively coupled to, and sealing engaged with, the access port.

18. A method of preventing water infiltration into one or both of a pump and a source of rotary force, the method comprising:

providing a coupling member as recited in claim 15;

sealingly engaging the first end of the coupling member with the pump;

sealingly engaging the second end of the coupling member with the source of rotary force; and securing a linkage, which is disposed within the passage of the coupling member, to at least one of the pump and the source of rotary force.

19. The method of claim 18, further comprising:

providing an air tank defining an air space of a predetermined volume therein, the air tank including:

an inlet; and an outlet; and sealingly engaging and coupling the inlet of the air tank to the drain port of the coupling member such that the passage and the air space are in fluid communication with each other.

* * * * *